US006131287A

United States Patent [19]

Prochaska et al.

[11] Patent Number: 6,131,287

[45] Date of Patent: Oct. 17, 2000

[54] RAZOR CARTRIDGE WITH DIMPLED BLADE GUARD

[75] Inventors: Frank H. Prochaska; John P. McAllister, both of Waynesboro, Va.

[73] Assignee: American Safety Razor Company, Verona, Va.

[21] Appl. No.: 09/318,239

[22] Filed: May 25, 1999

Related U.S. Application Data

[60] Provisional application No. 60/088,412, Jun. 8, 1998.

[51] Int. Cl.[7] ..... B26B 21/40

[52] U.S. Cl. ..... 30/34.2; 30/41; 30/81

[58] Field of Search ..... 30/34.2, 41, 77, 30/80, 81, 82; D28/47

[56] References Cited

U.S. PATENT DOCUMENTS

| | | | |
|---|---|---|---|
| D. 292,623 | 11/1987 | Iten | D28/47 |
| D. 415,615 | 10/1999 | Swanson et al. | D28/47 |
| 1,416,199 | 5/1922 | Hasselquist . | |
| 1,768,307 | 6/1930 | Bleloch et al. . | |
| 2,183,554 | 12/1939 | Evans | 30/84 |
| 4,741,103 | 5/1988 | Hultman | 30/34.2 |
| 4,998,347 | 3/1991 | Schächter | 30/34.2 |
| 5,056,222 | 10/1991 | Miller et al. | 30/77 |
| 5,092,042 | 3/1992 | Miller et al. | 30/77 |
| 5,191,712 | 3/1993 | Cook et al. | 30/34.2 |
| 5,456,009 | 10/1995 | Wexler | 30/77 |
| 5,524,347 | 6/1996 | Prochaska | 30/50 |
| 5,590,468 | 1/1997 | Prochaska | 30/41 |
| 5,903,979 | 5/1999 | Oldroyd | 30/41 |

FOREIGN PATENT DOCUMENTS

| | | |
|---|---|---|
| WO 96/02369 | 2/1996 | European Pat. Off. . |
| 3879 | 3/1889 | United Kingdom . |
| WO 97/171174 | 5/1997 | WIPO . |

*Primary Examiner*—Douglas D. Watts
*Attorney, Agent, or Firm*—McDermott, Will & Emery

[57] ABSTRACT

In order to improve adhesion between the skin and a razor guard provided at the leading edge of a razor cartridge, the guard is provided with a large number of small concavities. These are preferably, but not to limited to hemispherically shaped concavities and are discrete and thus isolated from one another. These concavities can act as suction cups that increase the adhesion between the skin and the guard and thus tension the skin as the razor is drawn thereover. These concavities or dimples can also contain a reserve of shaving preparation for release on multiple passes over the same area.

9 Claims, 5 Drawing Sheets

RAZOR CARTRIDGE WITH DIMPLED BLADE GUARD

This application claims the benefit of U.S. Provisional Application No. 60/088,412, filed Jun. 8, 1998.

BACKGROUND OF THE INVENTION

1. Field of the Invention

The present invention relates generally to a razor and more specifically, to a disposable razor cartridge having a blade guard that features a dimpled finish which promotes better shaving by adhering to the skin and providing reservoirs for shaving preparations.

2. Description of the Related Art

In order to promote better and smoother shaving it has been proposed to provide disposable cartridges with a variety of measures such as multiple blades, resilient blade supporting arrangements, pivotable mounts, and the like. It has also been proposed to provide strips of material that secrete shaving aid material to facilitate the shaving experience.

One such example is disclosed in U.S. Pat. No. 5,092,042, issued on Mar. 3, 1992 in the name of Miller et al. This arrangement features a strip that acts as a guard, which is located at the leading edge of the cartridge, and which is formed with a series of spaced oval-shaped apertures and transversely extending ridges. The ridges intersectingly cross and intercommunicate the oval-shaped apertures. The purpose of the ridges is to provide a friction-increasing effect which, in combination with a similar effect provided by the edges of the apertures, tensions the skin immediately upstream of the first of two blades and to move shave aid material toward the edge of the blade and the surface of the skin which is being traversed by the blades.

Another proposal disclosed in U.S. Pat. No. 5,056,222 issued on Oct. 15, 1991, also to Miller et al. contains a guard strip which is extruded from a mixture of water-insoluble matrix material such as polystyrene and a water-leachable polymeric shaving aid material such as polyethylene glycol and a polyethylene oxide. This guard strip is also provided with apertures and ridges to provide friction enhancement while transferring the polymeric shaving aid material to the face immediately upstream of the cutting edges of the dual blade arrangement which is used. In this arrangement, the apertures are essentially rectangular in shape and are shaped so as to be open at the leading end to permit shaving cream or the like to enter and accumulate therein.

However, these arrangements, while providing advancements in shaving technology, have suffered from the drawback that still further improvements in skin tensioning are required and that the technique of dragging ridged surfaces over the skin has limits which cannot be exceeded without running the risk of and abrasive uncomfortable sensation being imparted to the person shaving.

SUMMARY OF THE INVENTION

It is an object of the invention to provide a shaving guard for a razor cartridge which features a unique approach to skin tensioning and which is both simple and inexpensive to manufacture.

It is a further object of the invention to provide a shaving guard for a razor cartridge which uses a plurality of discrete concavities which are able to act as suction cups that grasp the skin and produce an adhesion between the guard and the skin which cannot be produced by dragging ridged members thereover.

It is a still further object of the invention to provide a shaving guard wherein, in addition to the discrete concavities providing the suction cup effect, the concavities also contain a reserve of shaving preparations for release during multiple passes over the same area and thus provide a so called "soap bar" effect.

In brief, these objects are achieved by an arrangement wherein, in order to improve adhesion between the skin and a razor guard provided at the leading edge of a razor cartridge, the guard is provide with a large number of small concavities. These are preferably, but not to limited to, hemispherically shaped concavities and are discrete so as to isolated from one another. These concavities can act as suction cups that increase the adhesion between the skin and the guard and thus tension the skin as the razor is drawn thereover. These concavities or dimples can also contain a reserve of shaving preparation for release on multiple passes over the same area.

BRIEF DESCRIPTION OF THE DRAWINGS

The various features and advantages of the invention will become more clearly appreciated as a description of the preferred embodiment is made with reference to the appended drawings in which.

DETAILED DESCRIPTION OF THE PREFERRED EMBODIMENTS

Figure 1:
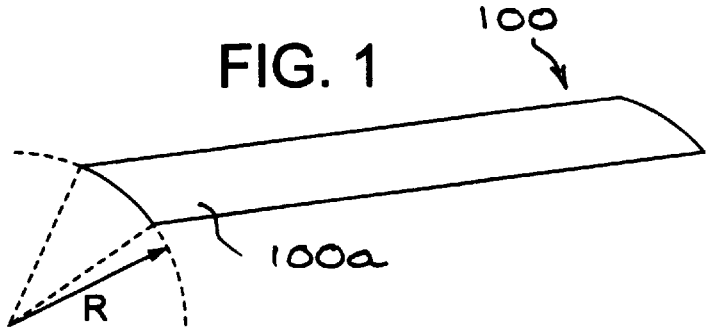
FIG. 1 is a schematic perspective view showing the basic shape of an embodiment of the blade guard which is used in accordance with the present invention.
Figure 2:
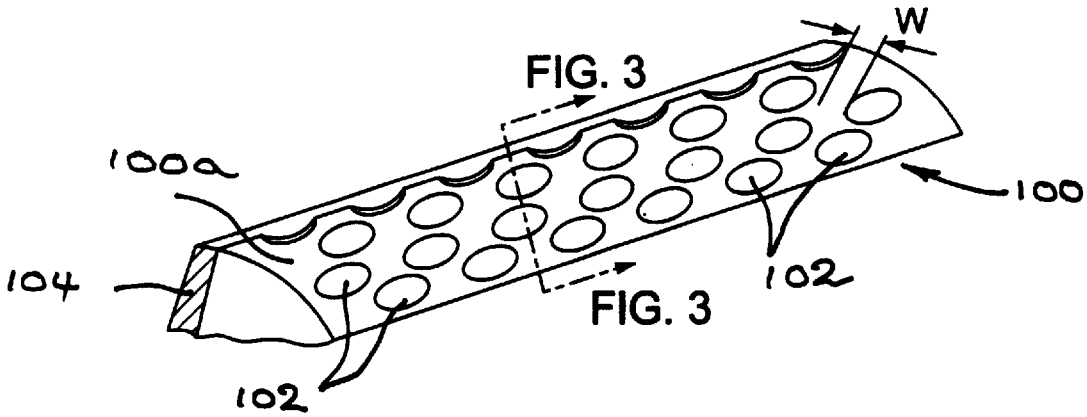
FIG. 2 is a perspective view illustrating the manner in which hemispherical dimple type concavities are formed in the blade guard in accordance with the present invention.
Figure 3:
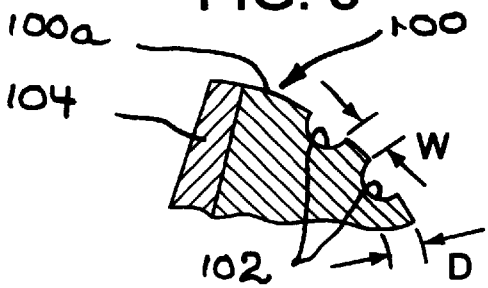
FIG. 3 is a sectional view as taken along section line 3—3 of FIG. 2.

FIGS. 1–3 show the basic features of the invention. In this arrangement, a blade guard 100, which is formed in accordance with the invention, has a cylindrically curved surface 100*a* containing a plurality of hemispherical indentations or cavities 102 which are discrete and separated from one another by a predetermined distance W. The guard 100 is formed of suitable elastomer such as TPR® (a thermoplastic polyolefinic elastomer marked by Uniroyal Chemical Company—see page 123 of Modem Plastic Encyclopedia 1982–83 published by McGraw-Hill Inc), and is set against a rigid wall 104 formed of styrene or the like. The cavities 102 by way of example, have a radius (R) of 0.005"–0.025", a depth (D) of 0.005"–0.025" and are arranged to be separated from one another by a distance or width (W) of 0.005–0.030". The elastomer from which the guard 100 is formed, can have, by way of example, a durometer reading of from 40–95 Shore A, or can be alternatively has hard as the plastic (e.g. styrene) from which the rigid wall is formed.

Figure 4:
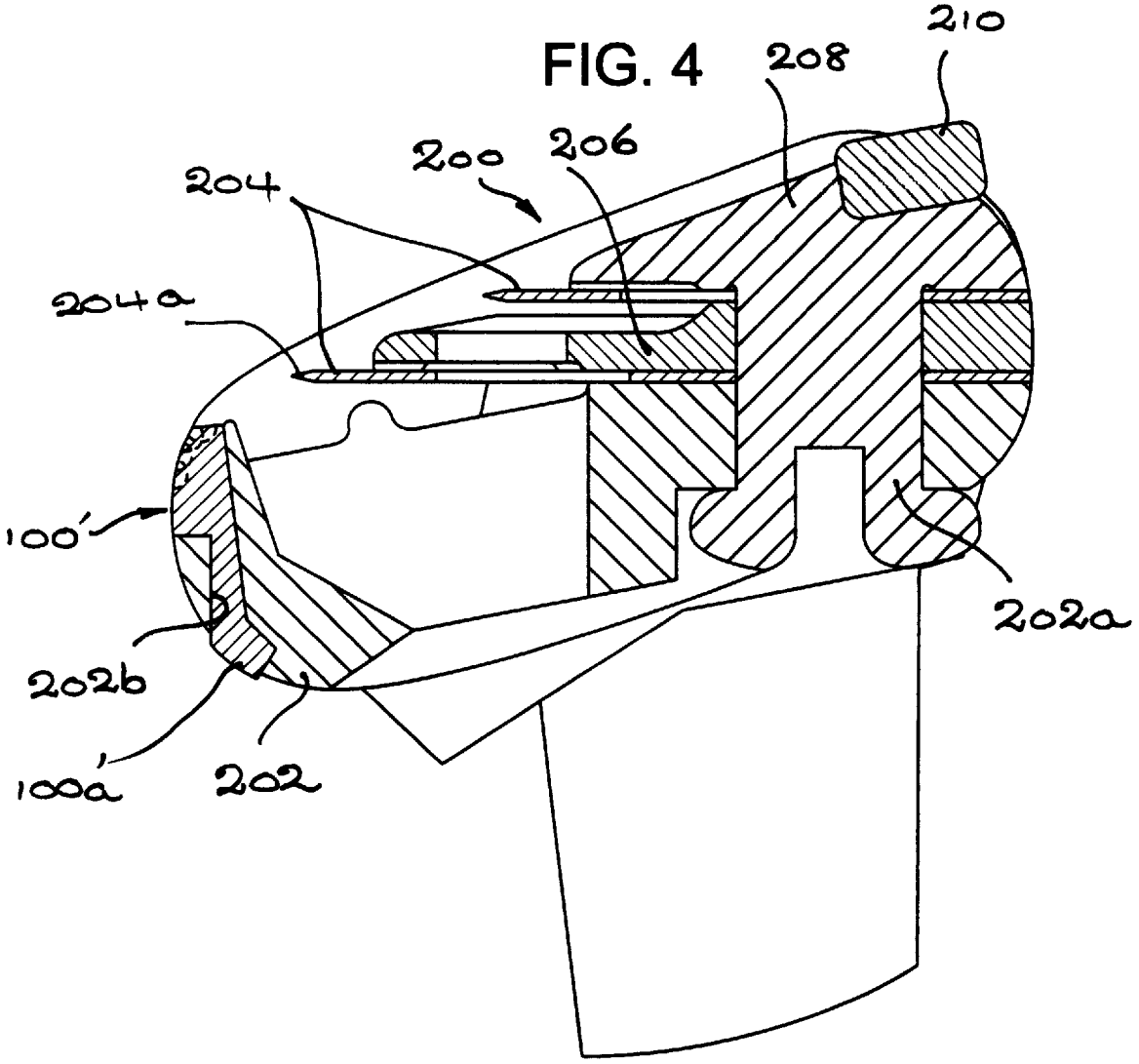
FIG. 4 is a side sectional view showing a razor cartridge equipped with a razor guard according to a first embodiment of the invention.

FIG. 4 shows a razor cartridge 200 that is equipped with a razor guard 100' according to a first embodiment of the invention. In this arrangement, the cartridge 200 which is adapted to be releasably mounted on a suitable handle (not shown), comprises a platform 202, flexible blades 204 and spacer 206, which separates the blades 204, and a cap member 208 which is rigidly connected to the platform 202 by way of integral fastening rivet portions 202*a* which extend down from a lower surface thereof. This arrangement further includes a lubricating strip 210 that is disposed along the upper rear edge of the cap 208.

In accordance with the invention, the razor guard, which takes the form of a dimpled strip or soap bar (as it will be referred to hereinafter), is disposed along the leading edge of the cartridge platform 202 immediately upstream of the position assumed by the leading cutting edge 204*a* of the multiple blade arrangement. In this particular arrangement, the leading edge of the platform 202 is formed with a cavity/passage structure 202*b* into which the soap bar 100' is injection molded. With this arrangement, it is possible to form the platform 202 and the soap bar 100' using a two shot molding process wherein the platform 202 is formed by injecting styrene (for example) and the soap bar 100' is formed using a second injection of TPR® (for example).

Figure 5:
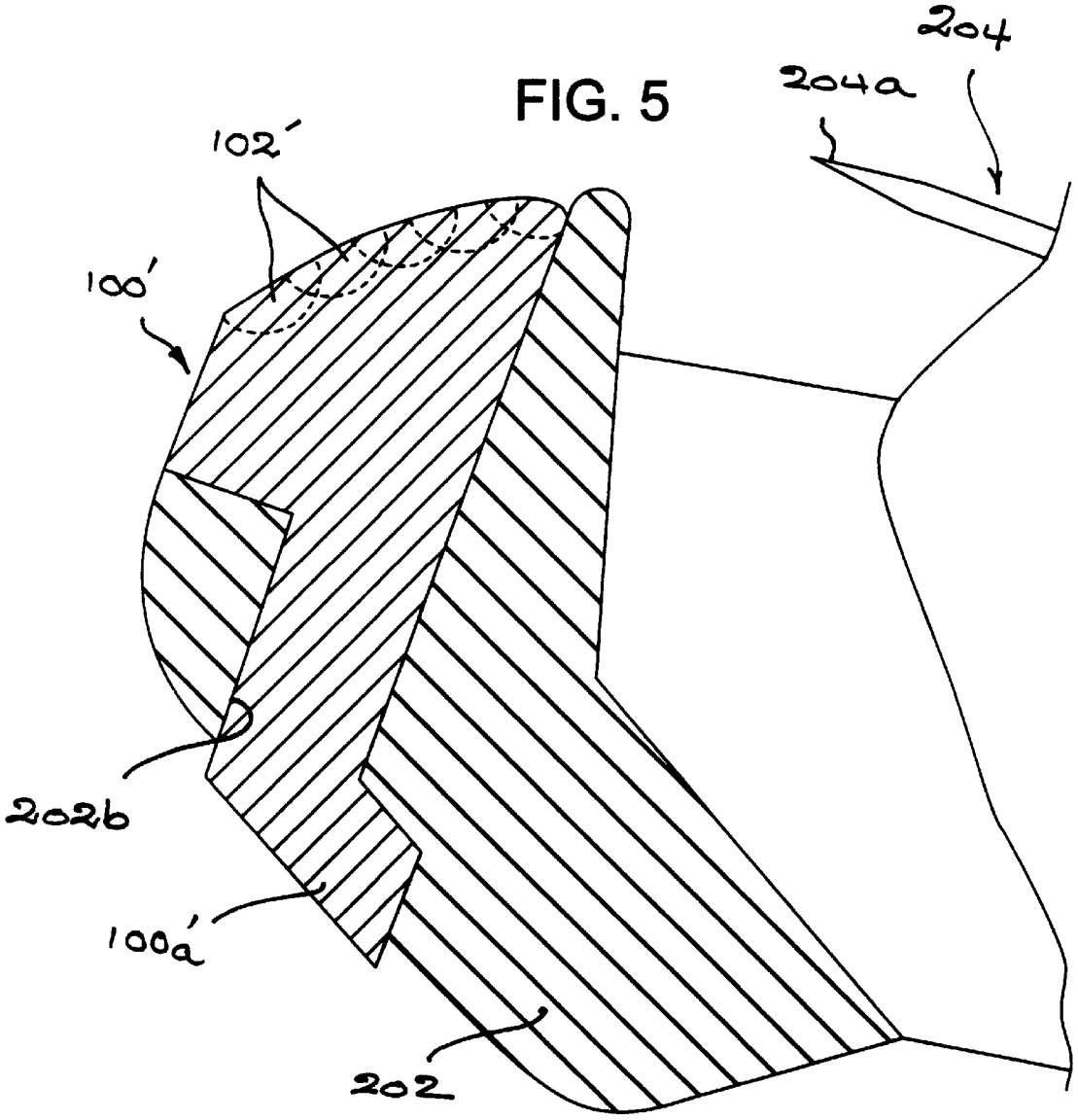
FIG. 5 is view showing an enlarged portion of the razor cartridge shown in FIG. 4.
Figure 6:
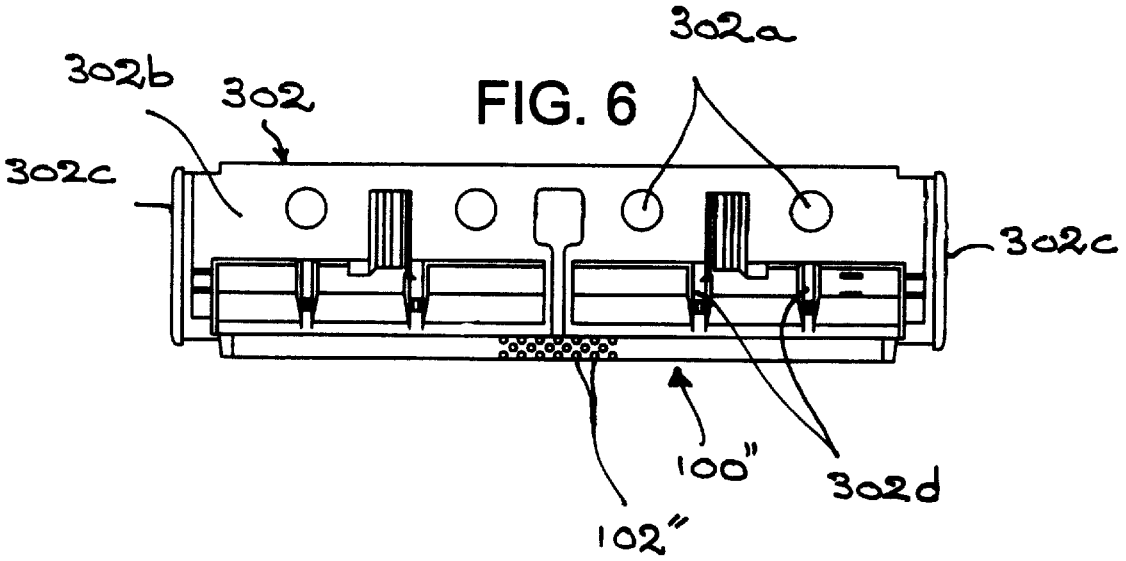
FIG. 6 is a plan view of razor cartridge platform that is equipped with a guard blade according to a second embodiment of the present invention.
Figure 7:
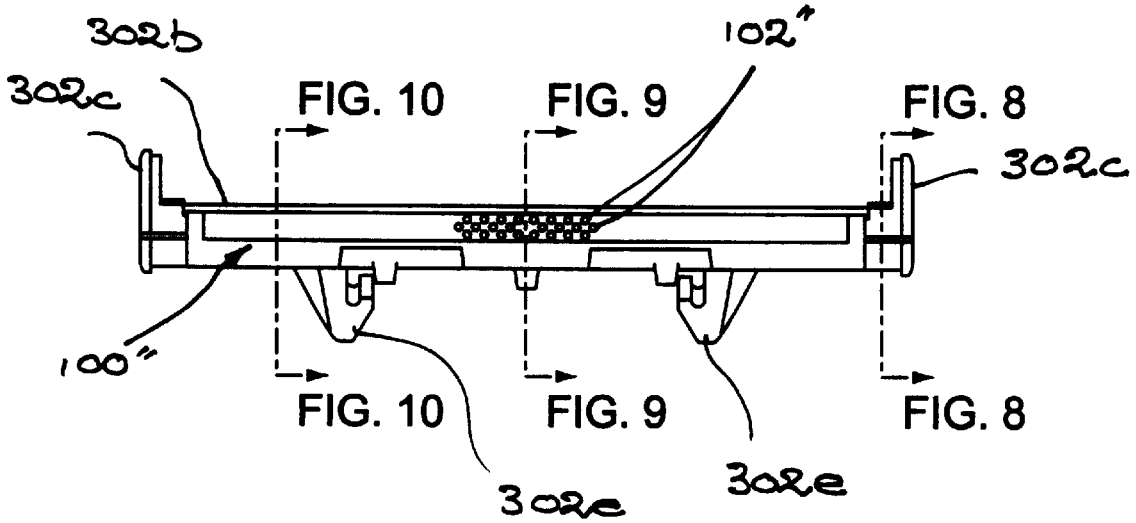
FIG. 7 is a front elevational view of the razor cartridge shown in FIG. 4.
Figure 8:
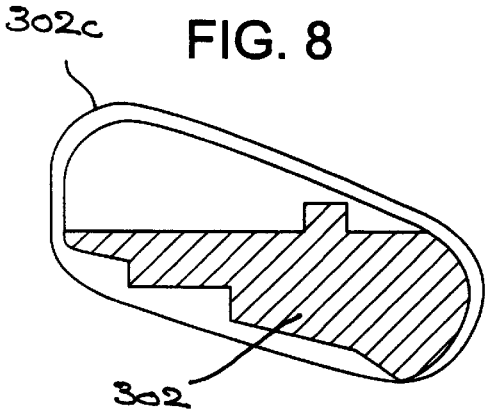
FIG. 8 is a sectional view taken along section line 8—8 of FIG. 7.

As will be appreciated from FIG. 5, which shows the soap bar structure 100' enlarged, the lower end of the bar is formed with a locking tab or tabs 100*a'* which prevent the elastomeric body from accidentally detaching from the platform 202. Dimples 102', which are formed in the upper surface of this soap bar, are hemispherical in configuration and have dimensions of the nature mentioned above.

Inasmuch as a description of a fully assembled cartridge is not necessary for a complete understanding of the invention and the enablement of its assembly and use, detailed reference will be had only to the portion of the device to which the inventive blade guard is connected. For a full and detailed description of a cartridge of an essentially similar construction, reference may be had to U.S. Pat. No. 5,524,347 issued on Jun. 11, 1996 and more particularly to U.S. Pat. No. 5,590,468 issued on Jan. 7, 1997. These references disclose the manner in which a platform member is provided flexible blade means, and a cap arrangement that is riveted in position on the platform in a manner that secures the blades in position. The content of these references is hereby incorporated by reference thereto.

It should also be understood that the present invention is not necessarily limited to the above type of cartridge arrangement and can be alternatively applied to cartridges of the nature disclosed in the above mentioned U.S. Pat. Nos. 5,092,042 and 5,056,222, for example. The content of these references is also incorporated by reference.

FIGS. 6–10 show a second embodiment of the invention. In the arrangement depicted in these figures, the soap bar 100" is molded onto a shaped surface formed at the leading edge of the razor cartridge platform 302. This process can again be carried out using a two shot molding process and is such as to achieve sufficient adhesion between the platform 302 and the soap bar 100" as to not require the formation of interlocking passages such as those (i.e. 202*b*) used in the first embodiment.

As will be appreciated, the structure which is shown in FIGS. 6–10, does not include a cap or a spacer member, and only details of the platform 302 on which the soap bar 100" is disposed, are illustrated in detail. As will be appreciated, the number of blades and the manner in which they are supported and secured to the platform can vary without departing from the scope of the invention.

In this embodiment, the platform 302 includes apertures 302*a* though which the connecting rivets of a cap member can be are disposed before being thermally treated and flared out to assume a locking condition. This platform further includes a blade support surface 302*b*, end wall portions 302*c*, support members 302*d*, and depending attaching hooks 302*e*.

Figure 9:
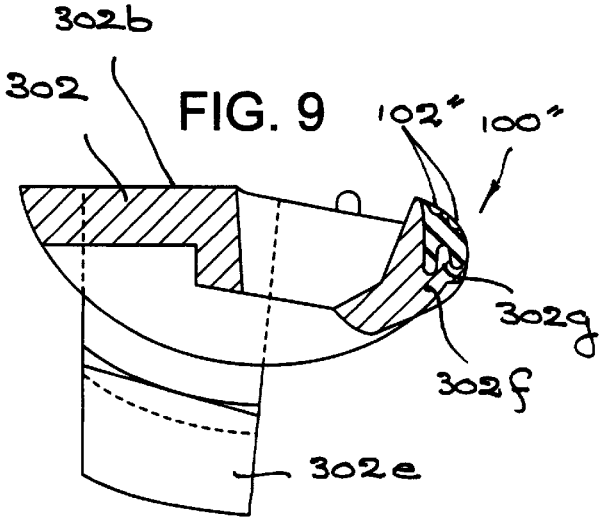
FIG. 9 is a sectional view taken along section line 9—9 of FIG. 7.
Figure 10:
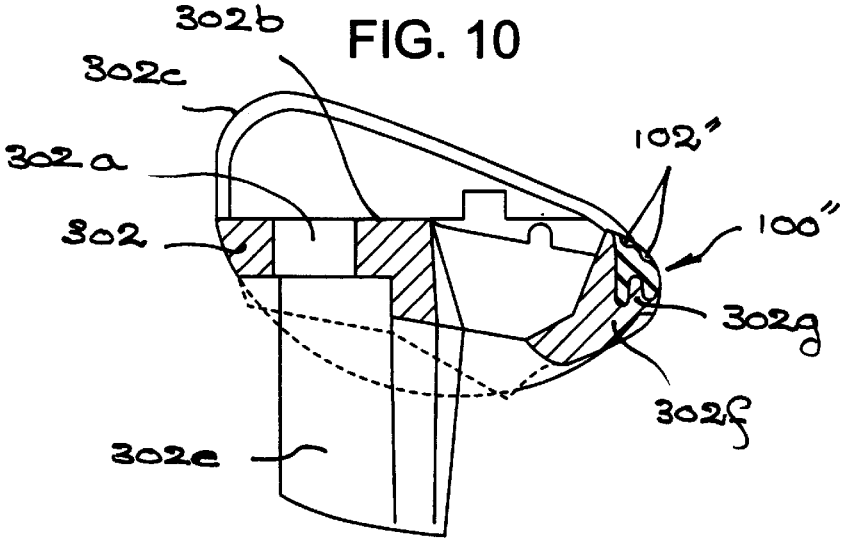
FIG. 10 is a sectional view taken along section line 10—10 of FIG. 7.
Figures 11A, 11B, 11C, 11D:
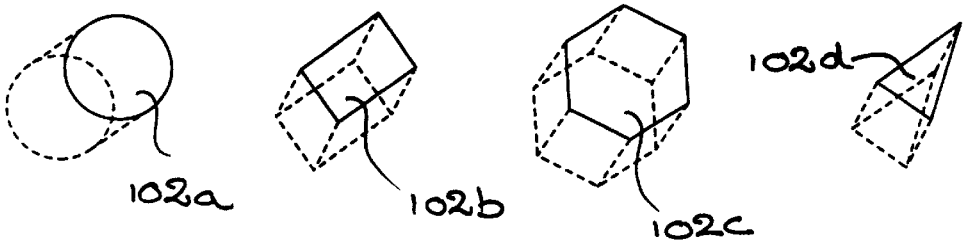
FIGS. 11A, 11B, 11C and 11D are views showing alternate possible concavity shapes which can be used in accordance with the present invention.

In order to achieve the above-mentioned adhesion between the soap bar 100" and the platform 302, the leading edge of the platform 302*f* is formed with a series of undulations/projections 302*g* which increase the surface area of the two members which are in contact with one another and which therefore improve the interconnection/adhesion therebetween, best shown in FIGS. 9 and 10. This formation, of course, serves in place of the passage structure that is used in the first embodiment shown in FIGS. 4 and 5. The shape of the undulations/projections 302*g* is not limited to those illustrated and various variants of these may be used without departing from the concept utilized in this embodiment.

FIGS. 11A to 11D show different cavity configurations which can be used with the present invention. As shown, in place of the hemispherical concavities or dimples which are used in the first and second embodiments of the invention, the use of cylindrical, cubical, octahedral or pentahedral cavities is also within the purview of the invention. It will be noted that all of these cavities are formed without projective lips or peripheral boss-like formations, and are such that the openings lie flush with the cylindrically curved surface of the soap bar.

While the invention has been described with reference to only a limited number of embodiments, the various changes and modifications which can be made without departing from the scope of the present invention, given the above description, will be self-evident to those skilled in the art to which the invention pertains. For example, while the platform has been described as being formed of styrene, the invention is not so limited and other plastics/polymers which exhibit the required physical characteristics such as Nylon®, polymethymethacrylate, polyesters such as PET, PETG, polyethylene, etc., for example, are not excluded from the purview of the invention. Likewise, while the soap bar has been described as being made of TPR® or other polymer/elastomers having suitable physical characteristics such as resiliency etc., such as polyisoprene, polybutadiene, polybutene, acrylonitriles etc., are similarly not excluded from the purview of the invention. Suitable compatibility between the two materials is of course preferable to assure the required level of interconnection during molding and to prevent unexpected separation and the like.

Additionally, while the embodiments have been directed to disposable types of razor cartridges, the invention may also be used on non-disposable units including electric razors that are adapted for wet shaves.

What is claimed is:

1. A razor comprising:

a platform for supporting a blade;

a blade guard disposed on said platform adjacent a cutting edge the blade, said blade guard having a plurality of uniformly sized, discrete, hemispherically shaped concavities which are spaced from one another, formed therein.

2. A razor comprising:

a platform for supporting a blade; a blade guard disposed on said platform adjacent a cutting edge the blade, said blade guard having a plurality of uniformly sized, discrete, hemispherically shaped concavities which are spaced from one another, formed therein, and wherein the hemispherically shaped cavities have a radius (R) of 0.005"–0.025", a depth (D) of 0.005"–0.025", and are separated from one another by a distance or width (W) of 0.005–0.030".

3. A razor as set forth in claim 1, wherein said blade guard is formed of an elastomer.

4. A razor as set forth in claim 3, wherein said blade guard is formed of an elastomer comprising: TPR®.

5. A razor as set forth in claim 1, wherein said platform is formed of a plastic comprising: styrene.

6. A disposable razor cartridge comprising:

a bar portion located adjacent a cutting edge of a blade and which precedes the blade during a shaving stroke; and means defining a plurality of discrete uniformly shaped and sized concavities in said portion for producing adhesion between a skin surface and the bar portion, said concavities being hemispherical in shade having a radius (R) of 0.005"–0.025", a depth (D) of 0.005"–0.025", and are separated from one another by a distance or width (W) of 0.005–0.030".

7. A disposable razor cartridge as set forth in claim 6, wherein said bar portion is located at a leading edge of a platform on which the blade is supported, said razor cartridge further comprising a cap member which is fastened to the platform in a manner which retains the blade thereon.

8. A disposable razor cartridge as set forth in claim 7, wherein the platform is formed of a plastic comprising: styrene.

9. A disposable razor cartridge as set forth in claim 6, wherein said bar portion is formed of an elastomer selected from among the group comprising: TPR®.

* * * * *